US006470499B1

(12) United States Patent
Joiner

(10) Patent No.: US 6,470,499 B1
(45) Date of Patent: Oct. 29, 2002

(54) PICTURE WINDOW

(76) Inventor: Clifton T. Joiner, 4276 Conway Blvd., Port Charlotte, FL (US) 33948

( * ) Notice: Subject to any disclaimer, the term of this patent is extended or adjusted under 35 U.S.C. 154(b) by 0 days.

(21) Appl. No.: 08/912,544

(22) Filed: Aug. 18, 1997

(51) Int. Cl.[7] ..... A41B 1/00
(52) U.S. Cl. ..... 2/69; 2/115; 2/171; 40/586
(58) Field of Search ..... 2/69, 1, 115, 108, 2/94, 105, 106, 171, 102, 244, 246; 40/586

(56) References Cited

U.S. PATENT DOCUMENTS 2,986,743 A * 6/1961 Eilen ..... 40/586
3,055,133 A * 9/1962 Anderson ..... 2/102
4,625,337 A * 12/1986 Zahn ..... 2/69
4,627,110 A * 12/1986 Tengs ..... 2/69
4,838,965 A * 6/1989 Bussard ..... 2/115 X
4,924,613 A * 5/1990 Levin ..... 40/586
5,173,968 A * 12/1992 Fox ..... 2/244
5,632,044 A * 5/1997 Sloot ..... 2/102

* cited by examiner

*Primary Examiner*—Gloria Hale

(57) ABSTRACT

A combination of three images printed on a side of an object with the first image providing a frame around an opening into the object, a second image representing a selected theme, printed within the area surrounded by the frame, and a third image printed outside the area of the first image consisting of a humorous phrase related to the second image.

8 Claims, 9 Drawing Sheets

SECTION 1-1

PICTURE WINDOW

BACKGROUND OF THE INVENTION

1. Field of the Invention

This invention relates generally to a window, and more specifically to an article having a first image of a window frame opening into a living or non-living organism, framing a second image of an object related to a third image of a quotation relating to the second image.

2. Discussion of the Prior Art

There are numerous clothing products on the market having images imprinted thereon relating to many real life situations. Many of the images relate to age, real life situations, and other events. In addition, there are "Tee" shirts containing images of sporting events, family events, and many other events. Each of the existing products feature a two dimensional image depicting some event or message. Attempts have been made to create a third dimension by imprinting the materials with thicker coatings of plastic. Another attempt to provide a third dimensional effect is to use a water/liquid filled clear and/or colored plastic cover. The most popular items frequently used to convey the many messages and events are "Tee" shirts. In addition, baseball caps and other hats are also used.

SUMMARY OF THE INVENTION

The present invention provides a combination of three images printed on an object, such as clothing, with a first image providing the appearance of a window or an opening looking inside a living or non-living organism, a second image representing a theme, and a third image providing a related quotation or description tying the first two images together. The concept of the invention may include any picture, image, figure, or print and may be printed on, in and or upon anything including clothing, materials, objects, walls, surfaces, and not excluding anything.

A first object of the invention is to provide the appearance of an opening, or window, looking inside a living or non-living organism, matter or non-matter, showing object(s), ideas, anything, and/or nothing, inside, internally, upon, and/or attached, whether real, fake, comical, non-comical, logos, designs, animation, or any other theme.

Another object of the invention is to provide an image depicting and/or representing sports, fads, movies, schools of any type, religions, people, animals, interest groups, nation(s), races, beliefs, faiths, worlds, ethnic groups, ideas, living organisms, non-living organisms, mechanical, non-mechanical, jobs, careers, and anything tangible or intangible.

DESCRIPTION OF THE PREFERRED EMBODIMENT

Figure 1:
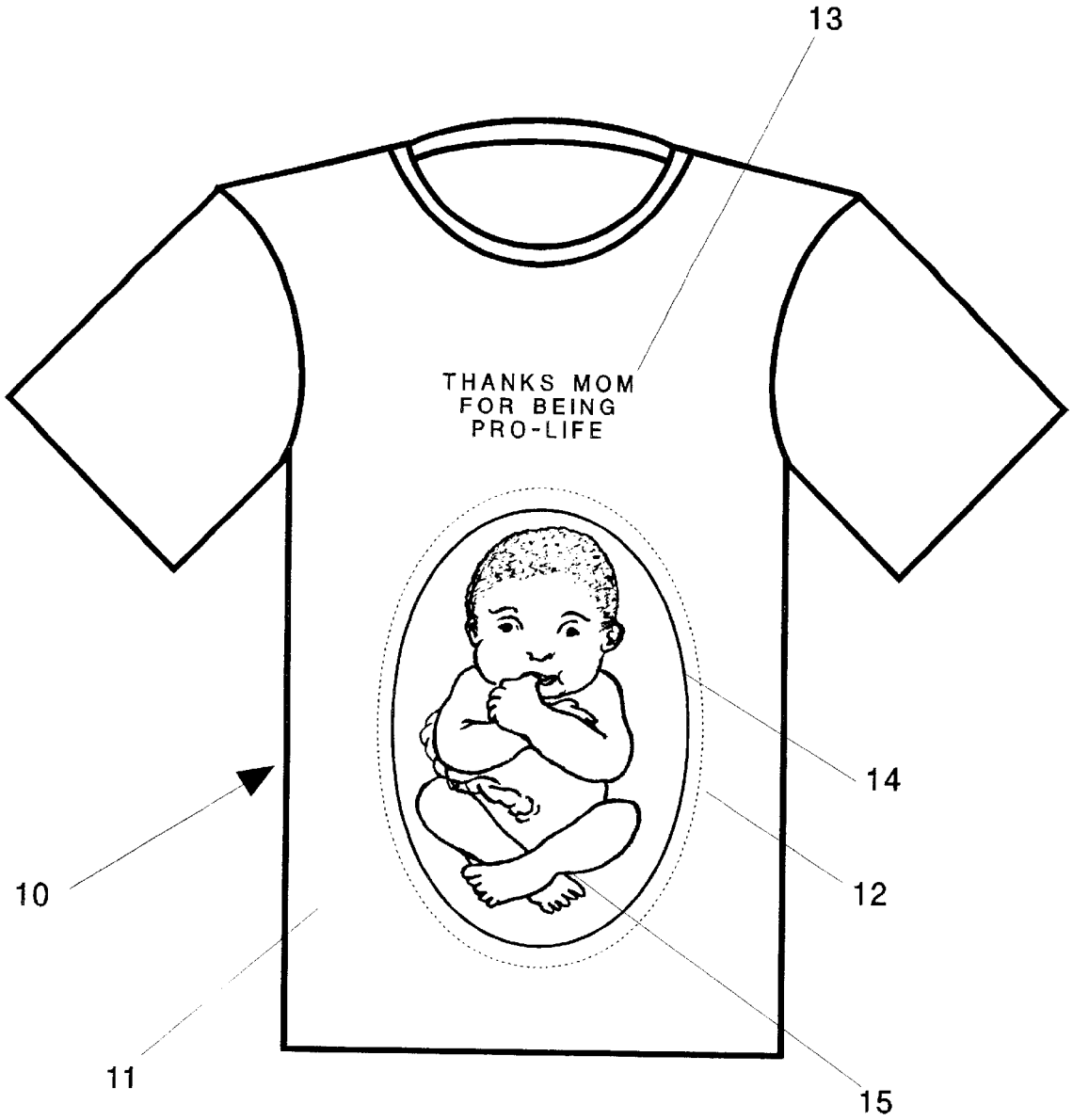
FIG. 1 is a front perspective view of a "Tee" shirt in accordance with the invention.

FIG. 1 is a front perspective view of a decorated Tee shirt indicated generally by the numeral 10. The shirt front 11 is shown with a first image 14 providing the appearance of a window or an opening looking inside a living organism or non-living organism, matter or non-matter, a second image 15 representing an object, idea, or other representation, and a third image 13 of a phrase related to a quotation or description tying the first image 14 and the second image 15 together. The shirt front 11 of the invention will generally have the first image 14 to simulate a window into the body, or other object, which is being used. With appropriate shading and raised printing, the image 15 will provide a realistic looking glimpse into the interior of the person or object when viewed from the front of the shirt front 11.

FIG. 1 is a front perspective view of a first embodiment of a Tee shirt 10 having a first image 14 with a second image 15 of an embryo, connected with an umbilical cord, in a womb, visible through the window of first image 14. A third image 13 of a phrase (THANKS MOM FOR BEING PRO-LIFE) is a humorous social message concerning abortions.

Figure 2:
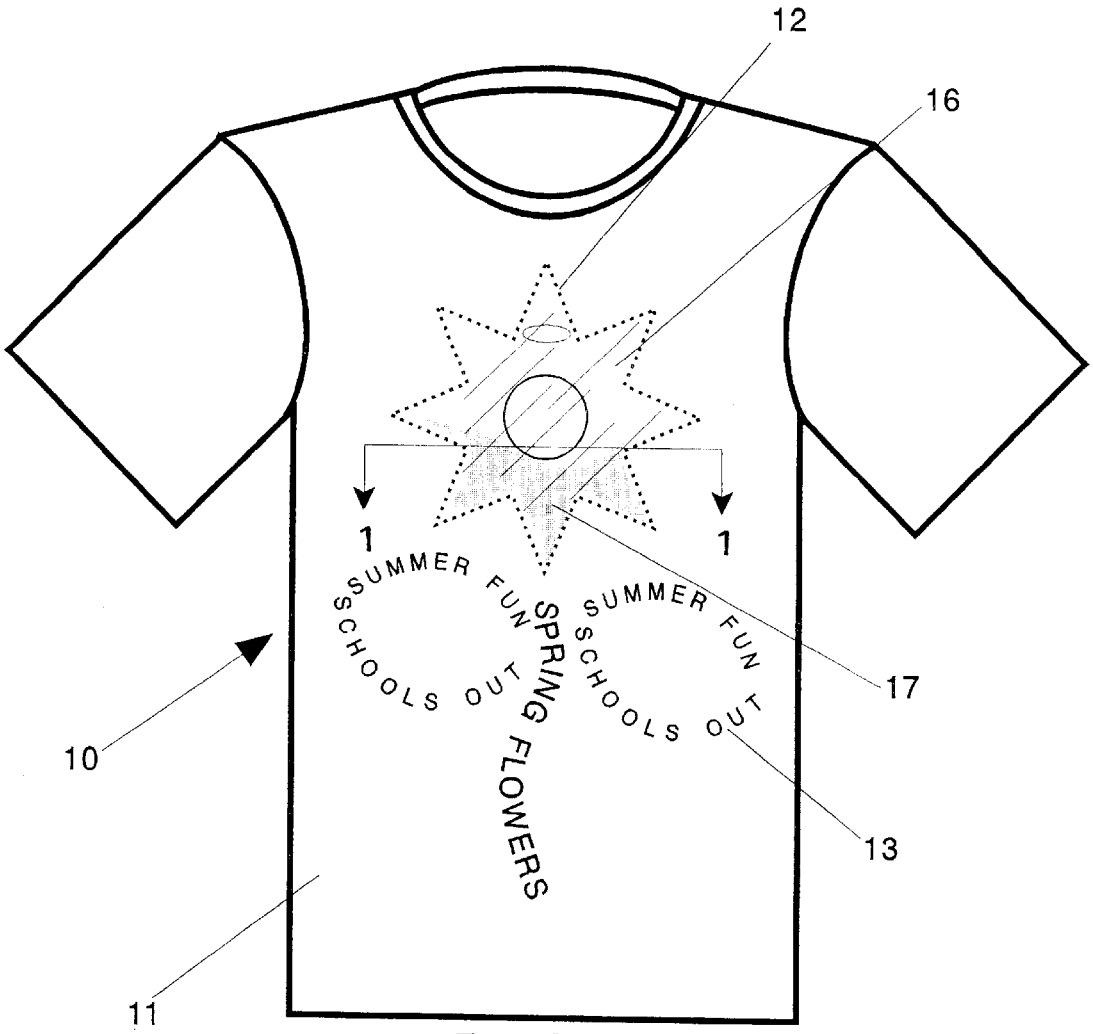
FIG. 2 is a front perspective view of an article of clothing having a liquid filled clear plastic cover.
Figure 3:
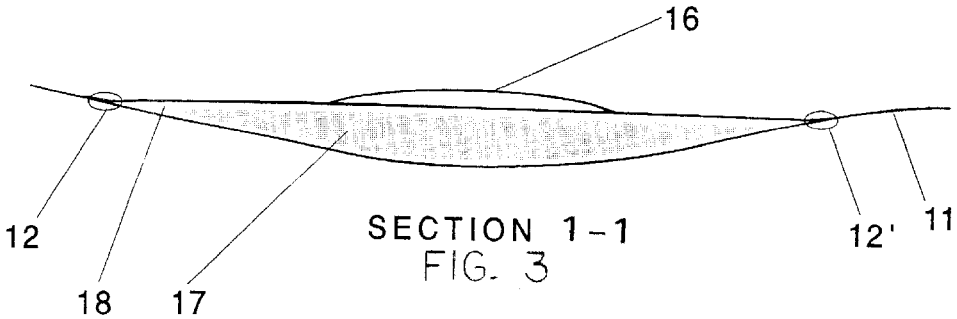
FIG. 3 is a sectional view of a liquid filled clear plastic cover.

FIGS. 2 and 3 depict a prior art attempt to provide a three dimensional effect by using a water/liquid filled clear and/or colored plastic cover 16. The dotted line 12 represents stitching or adhesive fastening which may be used to affix the plastic cover 16 to the "Tee" shirt front 11. The plastic cover 16 may be filled with a liquid 18 and have metallic colored plastic chips 17 floating within the liquid 18 to provide simulated action. An image 13 may also be printed on the shirt 11 to make some point or statement. The plastic cover 16 may also be used with the instant invention to provide an added effect of a window as used with the first image 14.

Figure 4:
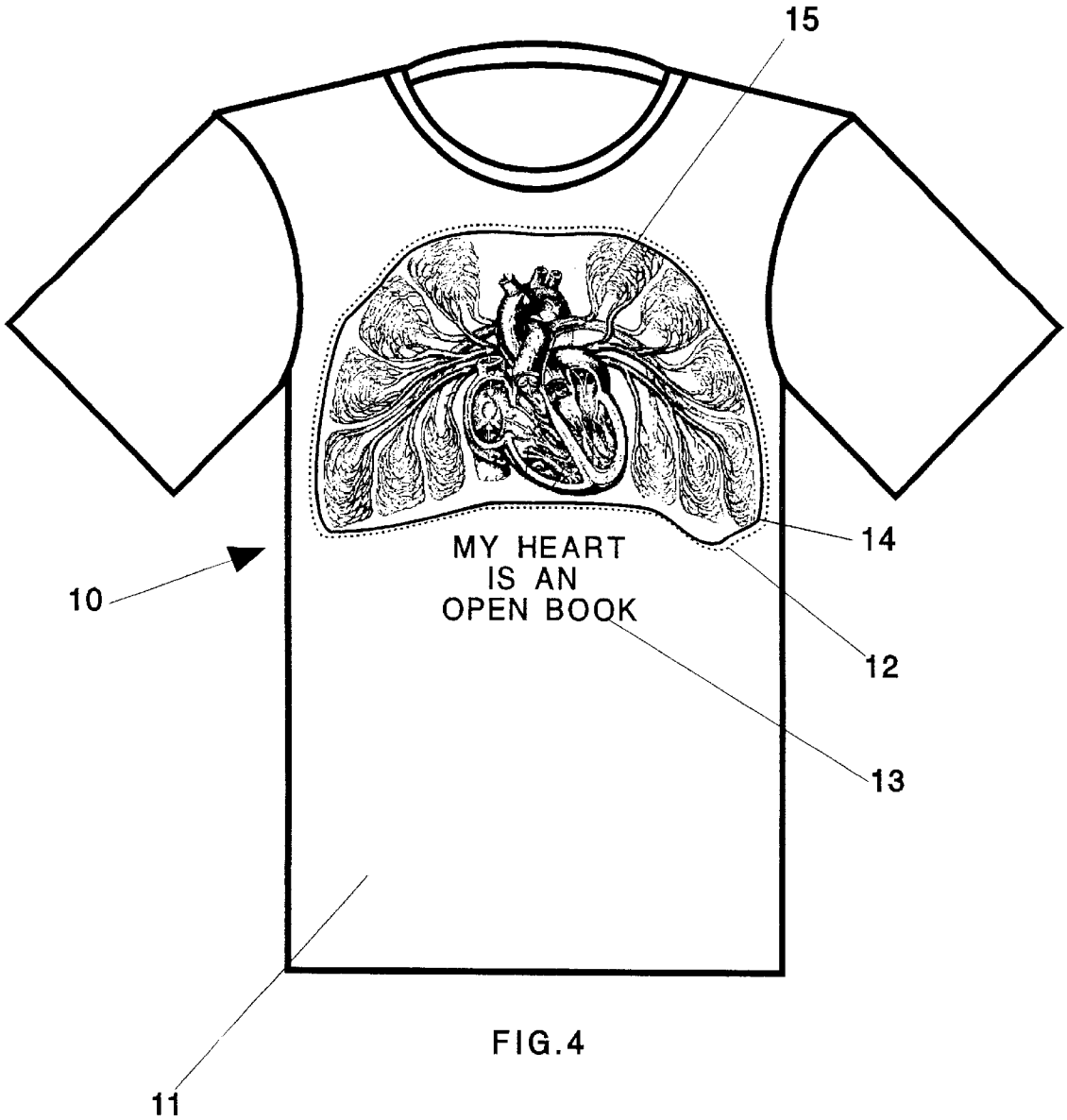
FIG. 4 is a front perspective view of a second "Tee" shirt in accordance with the invention.

FIG. 4 is a front perspective view of a second embodiment of a Tee shirt 10 having a first image 14 providing the appearance of a window, a second image of an open chest showing the heart and lungs visible through the window of first image 14. A third image 13 of a phrase (MY HEART IS AN OPEN BOOK) is a humorous message pertaining to an old, well known quotation.

Figure 5:
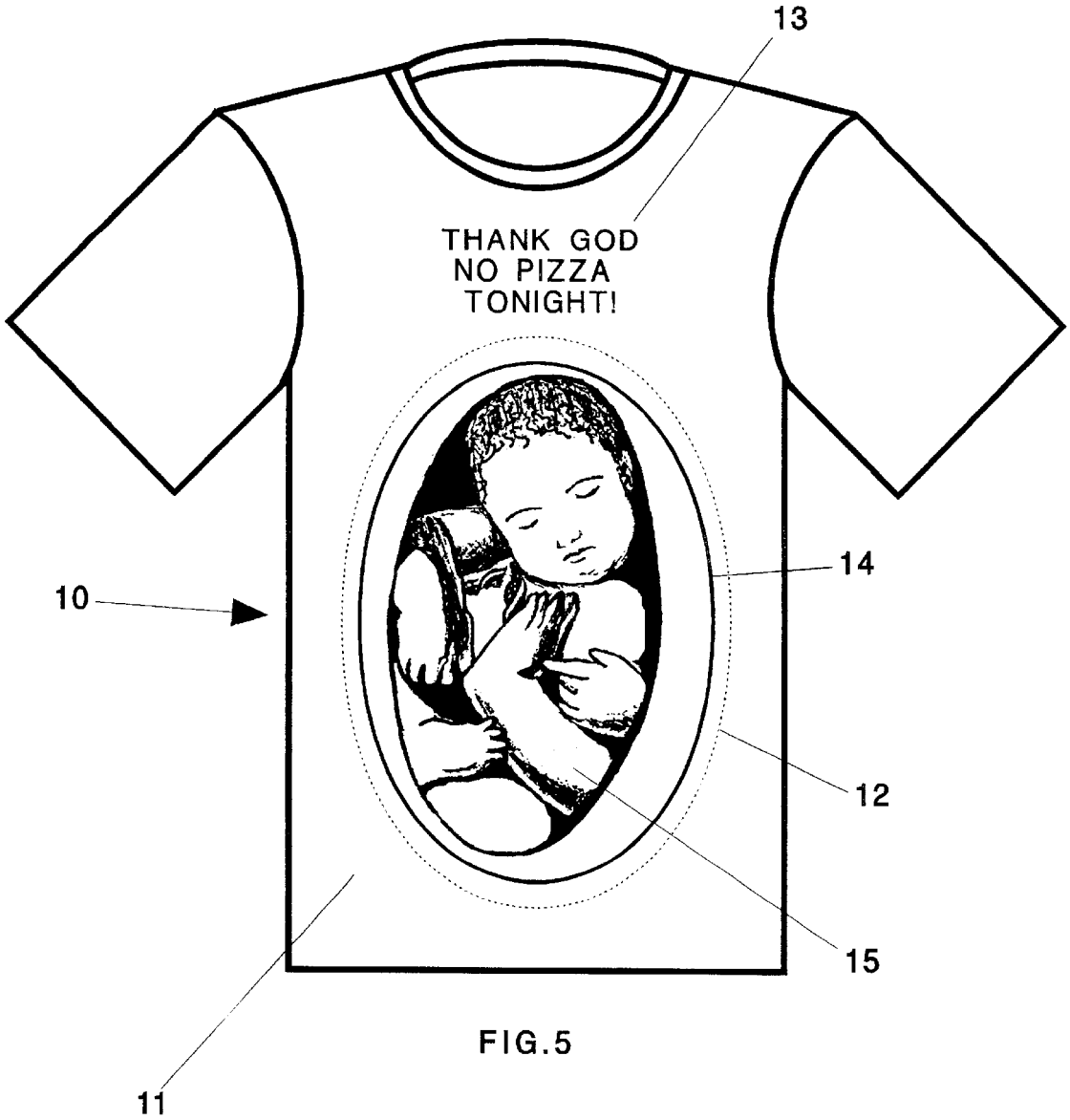
FIG. 5 is a front perspective view of a third "Tee" shirt in accordance with the invention.

FIG. 5 is a front perspective view of a third Tee shirt 10 having a first image 14 with a second image of a sleeping embryo, in a womb, visible through the window of first image 14. A third image 13 of a phrase (THANK GOD NO PIZZA TONIGHT) is a humorous message concerning the gastric effect of a pizza.

Figure 6:
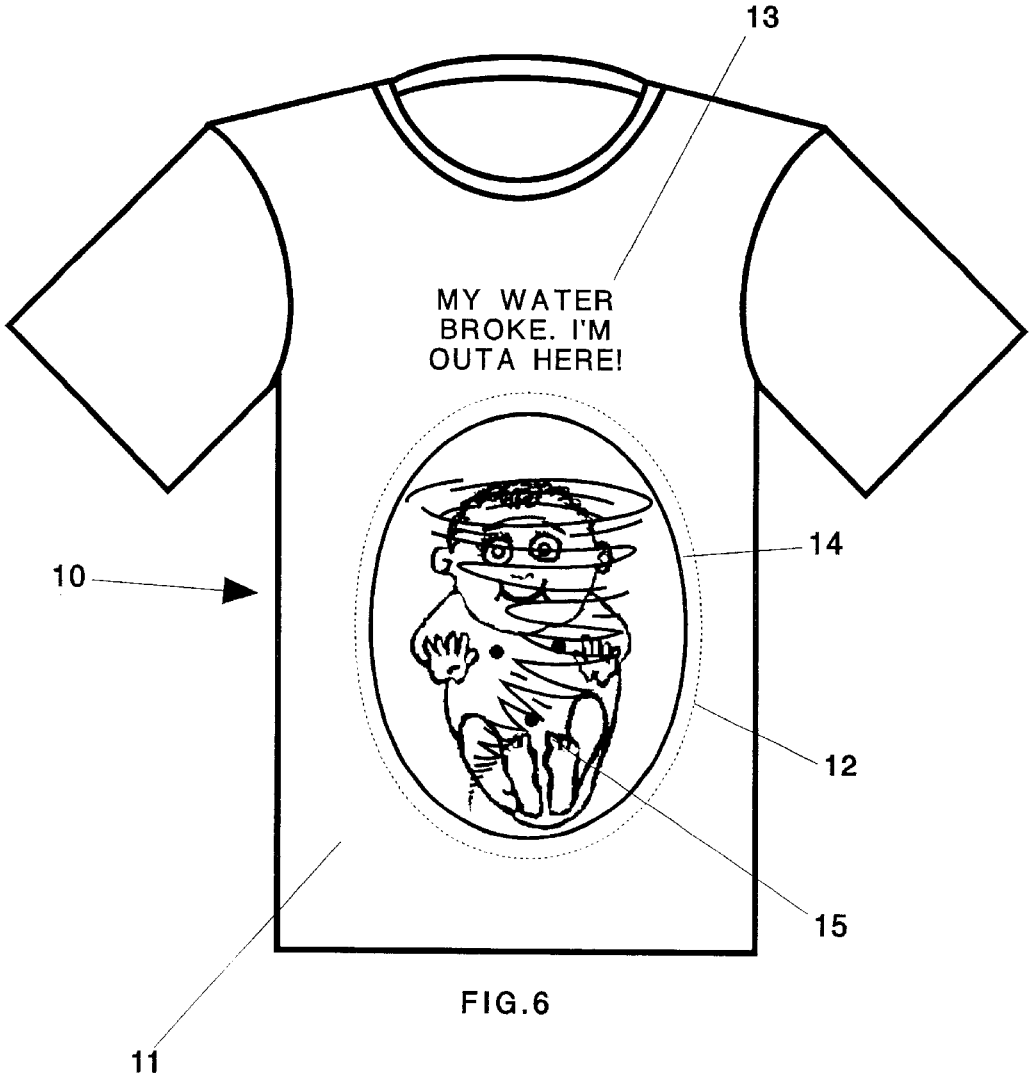
FIG. 6 is a front perspective view of a fourth "Tee" shirt in accordance with the invention.

FIG. 6 is a front perspective view of a fourth Tee shirt 10 having a first image 14 with a second image 15 of an embryo in the womb. A third image 13 of a phrase (MY WATER BROKE. I'M OUTA HERE) is a humorous message concerning a near delivery of the baby.

Figure 7:
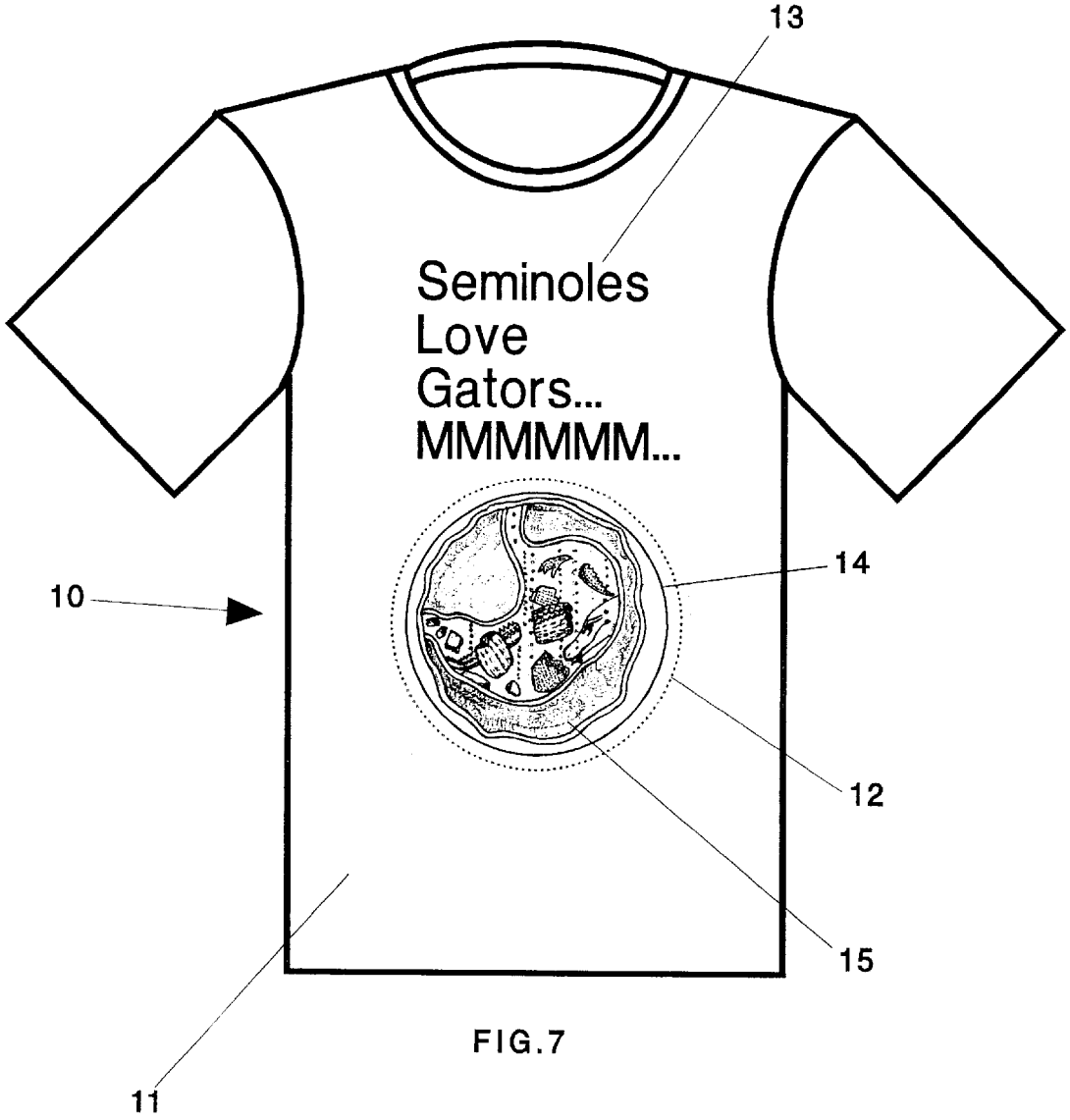
FIG. 7 is a front perspective view of a fifth "Tee" shirt in accordance with the invention.

FIG. 7 is a front perspective view of a fifth Tee shirt 10 having a first image 14 with a second image 15 of a human stomach visible through the window of first image 14. A third image 13 of a phrase (SEMINOLES LOVE GATORS . . . MMMMMM . . . ) a humorous message concerning two rival Florida colleges.

Figure 8:
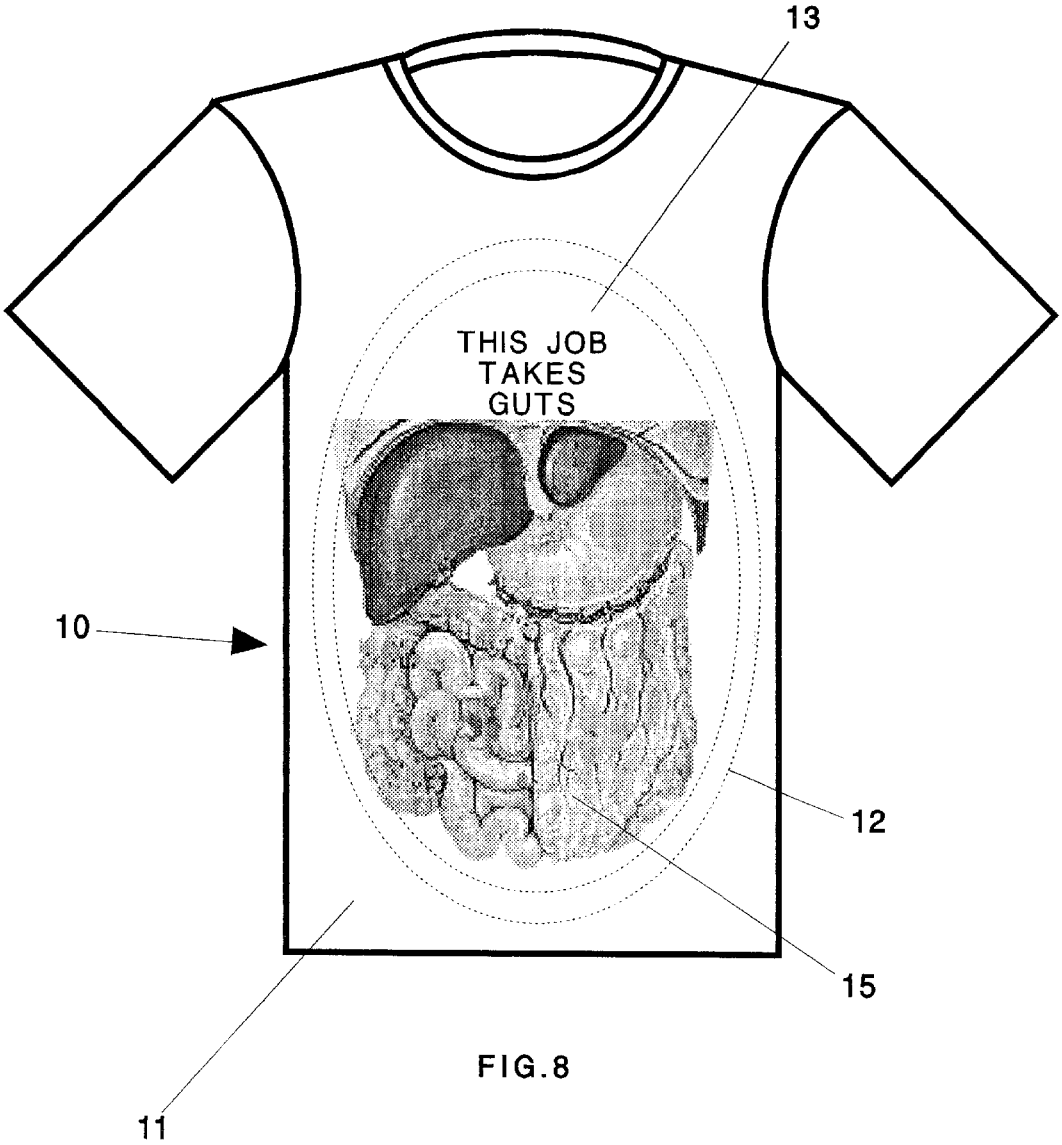
FIG. 8 is a front perspective view of a sixth "Tee" shirt in accordance with the invention.

FIG. 8 is a front perspective view of a sixth Tee shirt 10 having a first image 14 with a second image 15 of the intestines of a human visible through the window of first image 14. A third image 13 of a phrase (THIS JOB TAKES GUTS) is a humorous message concerning a trite expression.

Figure 9:
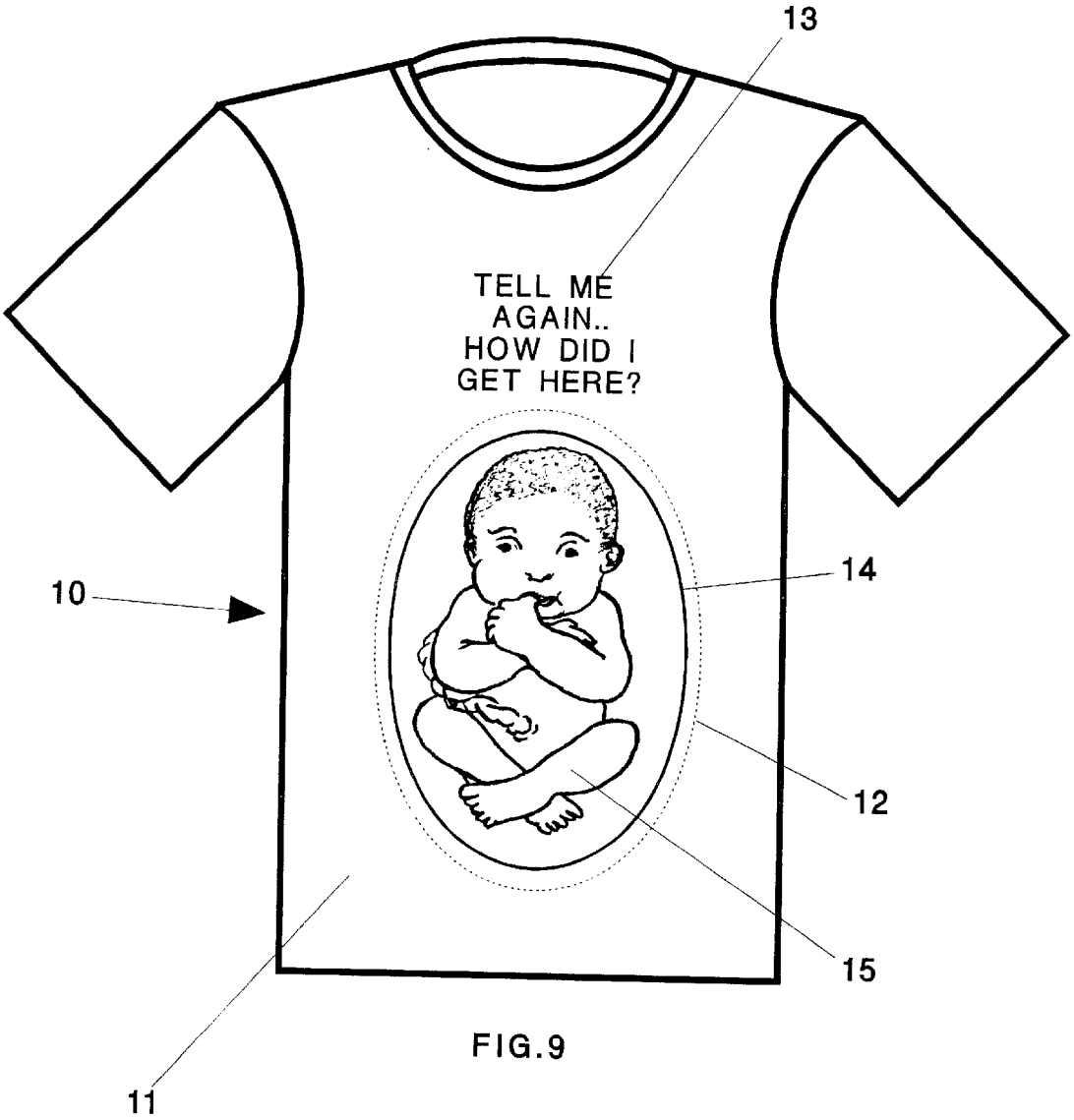
FIG. 9 is a front perspective view of a seventh "Tee" shirt in accordance with the invention.

FIG. 9 is a front perspective view of a seventh Tee shirt 10 having a first image 14 with a second image 15 of an embryo in a womb visible through the window of first image 14. A third image 13 of a phrase (TELL ME AGAIN . . . HOW DID I GET HERE?) is a humorous expression questioning the conception.

Figure 10:
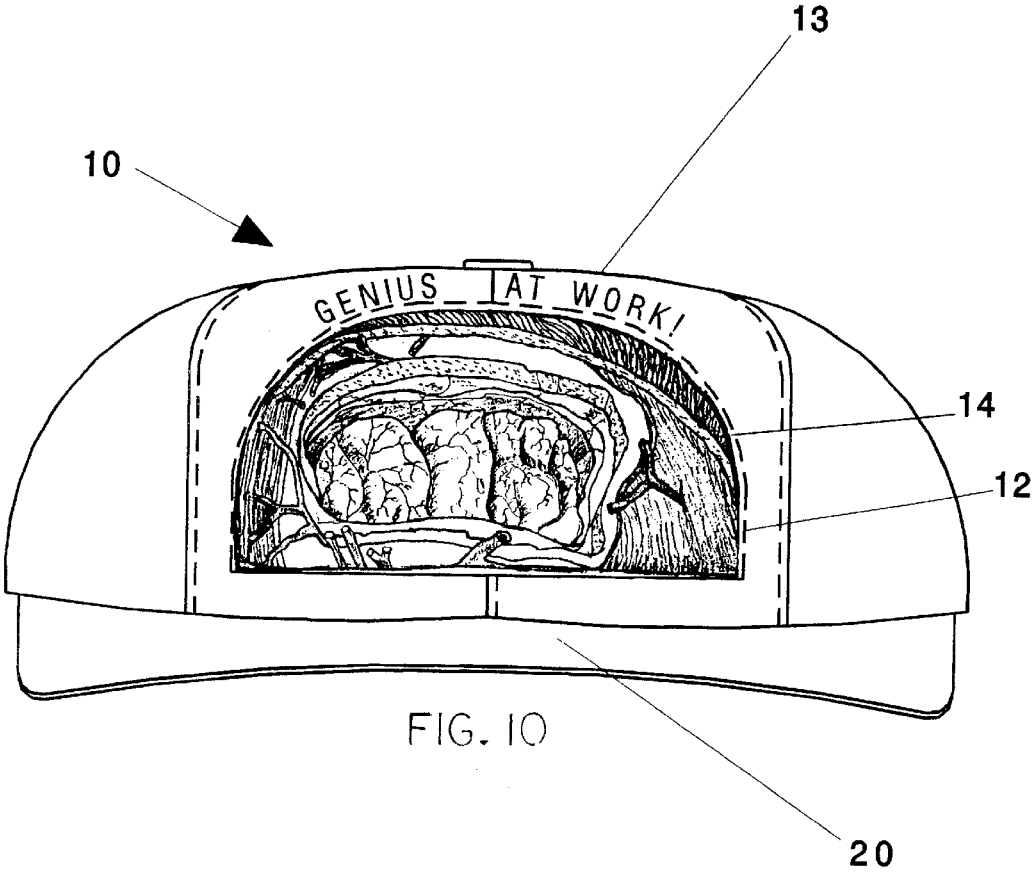
FIG. 10 is a front perspective view of the invention applied to a hat.

FIG. 10 is a front perspective view of the invention 10 applied to a hat and having a first image 14 with a second image 15 of an inside view of a cranium showing the brains. A third image 13 of a phrase (GENIUS AT WORK!) is a humorous expression pertaining to the workings of the brain.

The above examples of the use of the combination of images illustrate the flexibility and the numerous possible combinations of related images which can be used upon any type of surface or object, to give the appearance of a window, or opening, revealing the inside of the object.

While the invention has been explained with respect to a preferred embodiment thereof, it is contemplated that various changes may be made in the invention without departing from the spirit and scope thereof.

What is claimed is:

1. A combination of an article of clothing having a front, and three images printed on the front of the article of clothing, the images comprising:

a first image providing a frame formed around an image of an opening into the article of clothing looking inside an organism, a second image representing a selected theme, printed within said opening inside said organism, and surrounded by said frame, said second image being formed with shading and raised printing, thereby providing a realistic glimpse into said organism, said first and second images being covered with a clear plastic sheet adhered to said article of clothing by non-removable permanent means; and a third image formed outside said first image, said third image consisting of a phrase related to said second image.

2. The combination of claim 1 wherein said plastic sheet is filled with a liquid and metallic colored chips floating within said liquid.

3. The combination of three images of claim 1 wherein the article of clothing is a "Tee" shirt and said second image consists of a representation of a human internal organ.

4. The combination of three images of claim 3 wherein said second image consists of a representation of a womb having a fetus formed therein.

5. The combination of three images of claim 1 wherein said second image consists of a representation of a human stomach.

6. The combination of three images of claim 1 wherein the article of clothing is a hat and said second image consists of a human organ.

7. A combination of a "Tee" shirt and three images printed on the front of the "Tee" shirt, the images consisting of:

a first image providing a frame formed around an image of an opening into said "T" shirt looking inside a human body, a second image consisting of a human organ printed with shading and raised printing within said opening and surrounded by said frame, said second image being covered with a clear plastic sheet adhered to said "Tee" shirt by non-removable permanent means. and a third image printed outside the area of said first image, said third image consisting of a humorous phrase related to said second image.

8. The combination of claim 7 wherein said plastic sheet is filled with a liquid and metallic colored chips floating within said liquid.

* * * * *